US012097990B2

(12) United States Patent
Riolfo

(10) Patent No.: US 12,097,990 B2
(45) Date of Patent: Sep. 24, 2024

(54) PACKAGE FOR CONFECTIONERY PRODUCTS

(71) Applicant: SOREMARTEC S.A., Senningerberg (LU)

(72) Inventor: Nicola Riolfo, Rodello (IT)

(73) Assignee: SOREMARTEC S.A., Senningerberg (LU)

( * ) Notice: Subject to any disclaimer, the term of this patent is extended or adjusted under 35 U.S.C. 154(b) by 209 days.

(21) Appl. No.: 17/610,310

(22) PCT Filed: May 13, 2020

(86) PCT No.: PCT/IB2020/054526
§ 371 (c)(1),
(2) Date: Nov. 10, 2021

(87) PCT Pub. No.: WO2020/230048
PCT Pub. Date: Nov. 19, 2020

(65) Prior Publication Data

US 2022/0227521 A1 Jul. 21, 2022

(30) Foreign Application Priority Data

May 14, 2019 (IT) ..... 102019000006829

(51) Int. Cl.
*B65B 61/18* (2006.01)
*B65B 11/54* (2006.01)
(Continued)

(52) U.S. Cl.
CPC ..... *B65B 61/18* (2013.01); *B65B 11/54* (2013.01); *B65B 25/005* (2013.01);
(Continued)

(58) Field of Classification Search
CPC ..... B65B 11/54; B65B 25/005; B65B 25/006; B65B 61/005; B65B 61/02; B65B 61/18;
(Continued)

(56) References Cited

U.S. PATENT DOCUMENTS 9,834,353 B2 * 12/2017 Branyon ..... B32B 7/12
2003/0057206 A1 * 3/2003 Ishii ..... B65D 81/3415 219/727

(Continued)

FOREIGN PATENT DOCUMENTS

CN 105026284 A 11/2015
CN 106660674 A 5/2017

(Continued)

OTHER PUBLICATIONS

International Search Report and Written Opinion issued for International Application No. PCT/IB2020/054526 on Aug. 20, 2020, 11 pages.

(Continued)

*Primary Examiner* — Valentin Neacsu
(74) *Attorney, Agent, or Firm* — ROTHWELL, FIGG, ERNST & MANBECK, P.C.

(57) ABSTRACT

Described herein is a package (10) for a foodstuff product, in particular a confectionery product, comprising a wrapping sheet (2) wrapped around said product (P) so as to enclose it within a cavity (C) delimited by said sheet and so as to remain adherent to the outer surface of said product (P). The package is characterized in that it envisages a sealing portion (4), which is folded adherent to the portion of the sheet that defines the inner cavity (C) and which is provided with a point (6) of facilitated opening.

8 Claims, 3 Drawing Sheets

(51) Int. Cl.

| | |
|---|---|
| ***B65B 25/00*** | (2006.01) |
| ***B65B 61/00*** | (2006.01) |
| ***B65D 75/20*** | (2006.01) |
| ***B65D 85/60*** | (2006.01) |

(52) U.S. Cl.
CPC ..... *B65B 61/005* (2013.01); *B65D 75/20* (2013.01); *B65D 85/60* (2013.01)

(58) Field of Classification Search
CPC ..... B65B 61/182; B65B 61/184; B65D 75/20; B65D 85/60
USPC ..... 53/412, 133.7, 456; 229/87.05; 206/484
See application file for complete search history.

(56) References Cited

U.S. PATENT DOCUMENTS

| | | | | |
|---|---|---|---|---|
| 2004/0226267 | A1* | 11/2004 | Mansuino | B65B 9/073 53/550 |
| 2015/0329279 | A1* | 11/2015 | Romano | B65D 65/42 427/256 |
| 2016/0001950 | A1 | 1/2016 | Veternik et al. | |
| 2017/0129675 | A1 | 5/2017 | Terrasi | |
| 2017/0297761 | A1* | 10/2017 | Ishikawa | B65B 49/00 |
| 2018/0155104 | A1* | 6/2018 | Terrasi | B65D 85/60 |
| 2019/0337667 | A1 | 11/2019 | Dammers et al. | |
| 2022/0227521 | A1* | 7/2022 | Riolfo | B65B 25/005 |

FOREIGN PATENT DOCUMENTS

| | | | | |
|---|---|---|---|---|
| CN | 107264910 | A | 10/2017 | |
| CN | 107531384 | A | 1/2018 | |
| DE | 202015100458 | U1 | 2/2015 | |
| EP | 0591742 | A1 | 4/1994 | |
| EP | 0790184 | A1 | 8/1997 | |
| EP | 1046579 | B1 | 3/2004 | |
| EP | 2222567 | A1 | 9/2010 | |
| EP | 2332842 | A1 | 6/2011 | |
| EP | 3288847 | A1 | 3/2018 | |
| WO | 2008142497 | A1 | 11/2008 | |
| WO | WO-2016174557 | A1 * | 11/2016 | B65B 11/48 |

OTHER PUBLICATIONS

Office Action issued for Chinese Patent Application No. 202080043298.8 on Feb. 11, 2023, 7 pages.
Italian Search Report issued in Italian Patent Application No. 201900006829 on Jan. 10, 2020, 7 pages.

* cited by examiner

PACKAGE FOR CONFECTIONERY PRODUCTS

CROSS REFERENCE TO RELATED APPLICATION(S)

This application is a 35 U.S.C. 371 National Phase Entry Application from PCT/IB2020/054526 filed May 13, 2020, which claims priority to Italian Application No. 102019000006829, filed May 14, 2019. The entirety of the disclosures of the above-referenced applications are incorporated herein by reference.

The present invention relates to the sector of packaging of foodstuff products and has been developed with particular reference to packaging of confectionery products.

In this field, wrapping packages that hermetically seal the product are already known and are increasingly widespread, especially for packaging pralines.

The above type of package presents, in fact, the advantage of protecting the product more efficiently from possible contamination from outside, and prolonging conservation of the product.

In this regard, the documents EP 0591742A1, EP 1046579B1, EP 0790184A1, EP 2222567, filed in the name of the present applicant, describe hermetically sealed packages constituted by two wrapping sheets coupled and sealed together, which enclose the product between them.

The document EP 3288847A1, once again filed in the name of the present applicant, describes, instead, a package constituted by a single wrapping sheet, which is folded on itself around the product and closed hermetically by sealing its flaps set in mutual contact.

A technical problem concerning the above packages regards opening thereof by the consumer.

In this connection, the document EP 3288847 proposes a solution for facilitated opening of the package that comprises a tear strip applied on the inner side of the sheet, a notch made on the sheet at one end of the tear strip, and an adhesive label applied over the notch, on the outer side of the folded sheet so as to prevent any communication through it between the inside and the outside of the package.

In general, the solutions for facilitated opening of packages of the type in question must satisfy the following requisites:

- be simple to obtain both in terms of process and in terms of product;
- be such as to be integrated in the structure of the package, without altering—at least not appreciably—its aesthetic appearance; and
- enable easy and intuitive opening.

In this context, the present invention proposes a new package that is improved as compared to the known solutions.

The characteristics of the package described herein are recalled in the ensuing claims. The present invention moreover regards a method.

Further characteristics and advantages of the invention will emerge clearly from the ensuing description with reference to the annexed drawings, which are provided purely by way of non-limiting example and in which.

In the ensuing description, various specific details are illustrated aimed at providing an in-depth understanding of the embodiments. The embodiments may be obtained without one or more of the specific details, or with other methods, components, or materials, etc. In other cases, known structures, materials, or operations are not illustrated or described in detail so that various aspects of the embodiment will not be obscured.

The references used herein are provided only for convenience and hence do not define the sphere of protection or the scope of the embodiments.

As mentioned in the introductory part, the package described herein is designed for packaging foodstuff products, in particular confectionery products.

A preferred application regards the packaging of pralines or confectionery products that resemble them in shape and dimensions.

Reference to this context of application is not, however, to be interpreted as in any sense limiting the sphere of protection of the invention, and the teachings that will be presented in what follows may be adopted, in general, for packaging any foodstuff product, hence also including salted products.

Figure 1A:
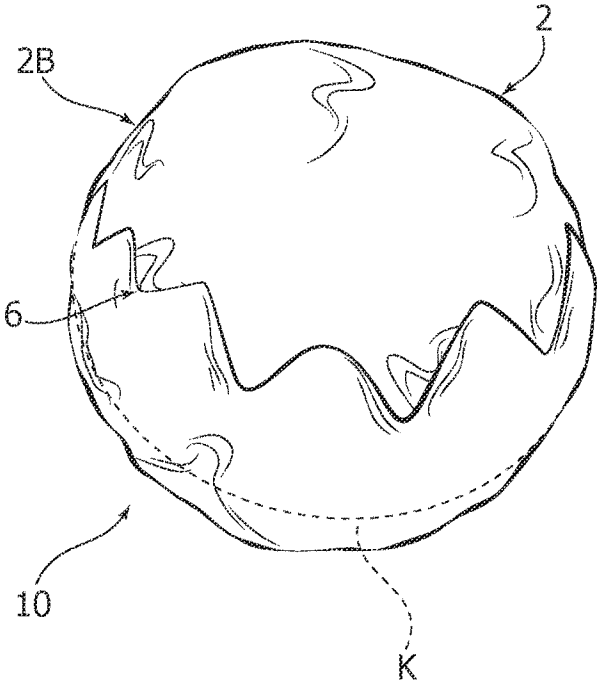
FIG. 1A illustrates the package of FIG. 1 according to a perspective view from beneath.
Figure 1:
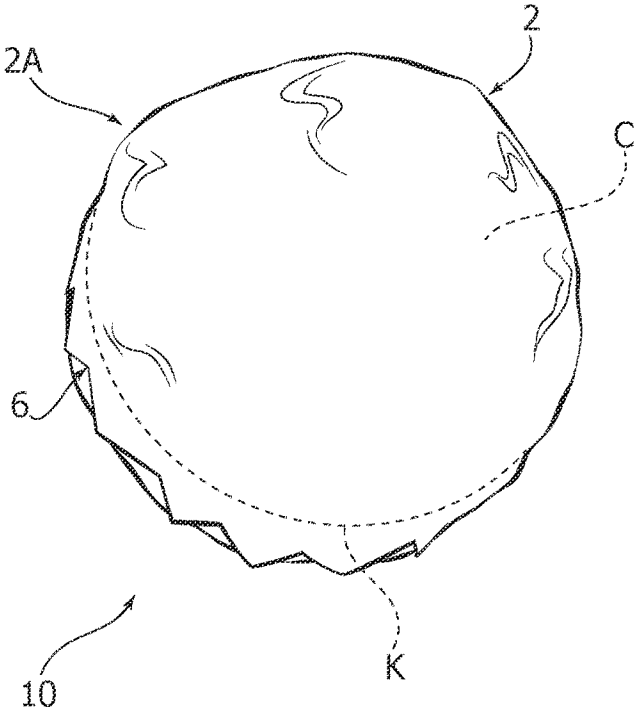
FIG. 1 represents a preferred embodiment of the package described herein according to a perspective view from above.

FIG. 1 illustrates by way of example the package described herein applied on a generic product P of a substantially spherical shape. The shape of the product does not, however, constitute a limitation of the sphere of application of the package, so that the product could in general have any shape.

With reference now to FIG. 1, in general the package described herein—as a whole designated in the figures by the reference number 10—comprises a wrapping sheet 2 that is wrapped around the product P so as to enclose the latter within it, inside a cavity C delimited by the sheet itself.

Throughout its extension, the sheet 2 remains adherent to the outer surface of the product P.

The sheet 2 wrapped around the product has a first side 2A and a second side 2B opposite to one another.

The side 2A corresponds to the display side of the package, whereas the side 2B is to remain substantially hidden from view.

With particular reference to its application for pralines, it should be noted, for example, that in some cases these can be sold, in a number of units, in trays where they are arranged in an orderly way alongside one another, in one or more rows, or else they can be sold individually, within individual cups.

In these examples, the sides 2A and 2B represent, respectively, the upper side and the lower side of the package, thus defined with respect to the condition in which the package is located in the tray and/or cup.

In other cases, for example in applications for Easter eggs, the two sides 2A and 2B of the wrapping sheet 2 may, instead, represent the front side and the rear side of the package.

It will, inter alia, be evident to the person skilled in the sector that the orientation of the sides 2A, 2B may depend both upon the type of product and upon the modality with which the package is sold.

It is, however, clear that the package described herein may be sold according to any modality (for example, in bags), and that the mode of sale is not hence to be understood as a limiting characteristic.

Hereinafter, reference will continue to be made to the sides 2A and 2B as upper side and lower side of the package, consistently with the example illustrated.

With reference now to FIG. 1A, the sheet 2 has a sealing portion 4 constituted by flaps of the sheet set in contact with one another, and sealed or glued together.

As will be seen hereinafter, the above portion 4 originates from a substantially equatorial plane of the product P, where the aforesaid flaps meet up, and that separates the upper side 2A of the package from the lower side 2B.

The portion 4 is folded on the lower side 2B, thus setting itself up against a corresponding portion of the sheet 2 that is in contact with the product P.

The folding line K substantially corresponds to the line along which the flaps of the sheet meet up in the aforesaid equatorial plane so that the folded portion 4 remains adherent to the corresponding portion of the sheet against which it is in contact and substantially assumes the same shape as the latter.

The end edge 41 of the portion 4 is provided with at least one tear-triggering point 6 to enable tearing of the sheet. The point 6 constitutes a point of facilitated opening of the package. In what follows, more details will be provided regarding the possible modalities of formation of this point.

Chiefly, it should now be noted that, when the portion 4 is in the folded condition, the point 6 comes to be positioned on the lower side 2B of the package, underneath the equatorial plane of the product P.

On the upper side 2A, the portion 4 and the tear-triggering point 6 are not visible, so that the package can maintain the same appearance as that of a conventional package.

Figure 2:
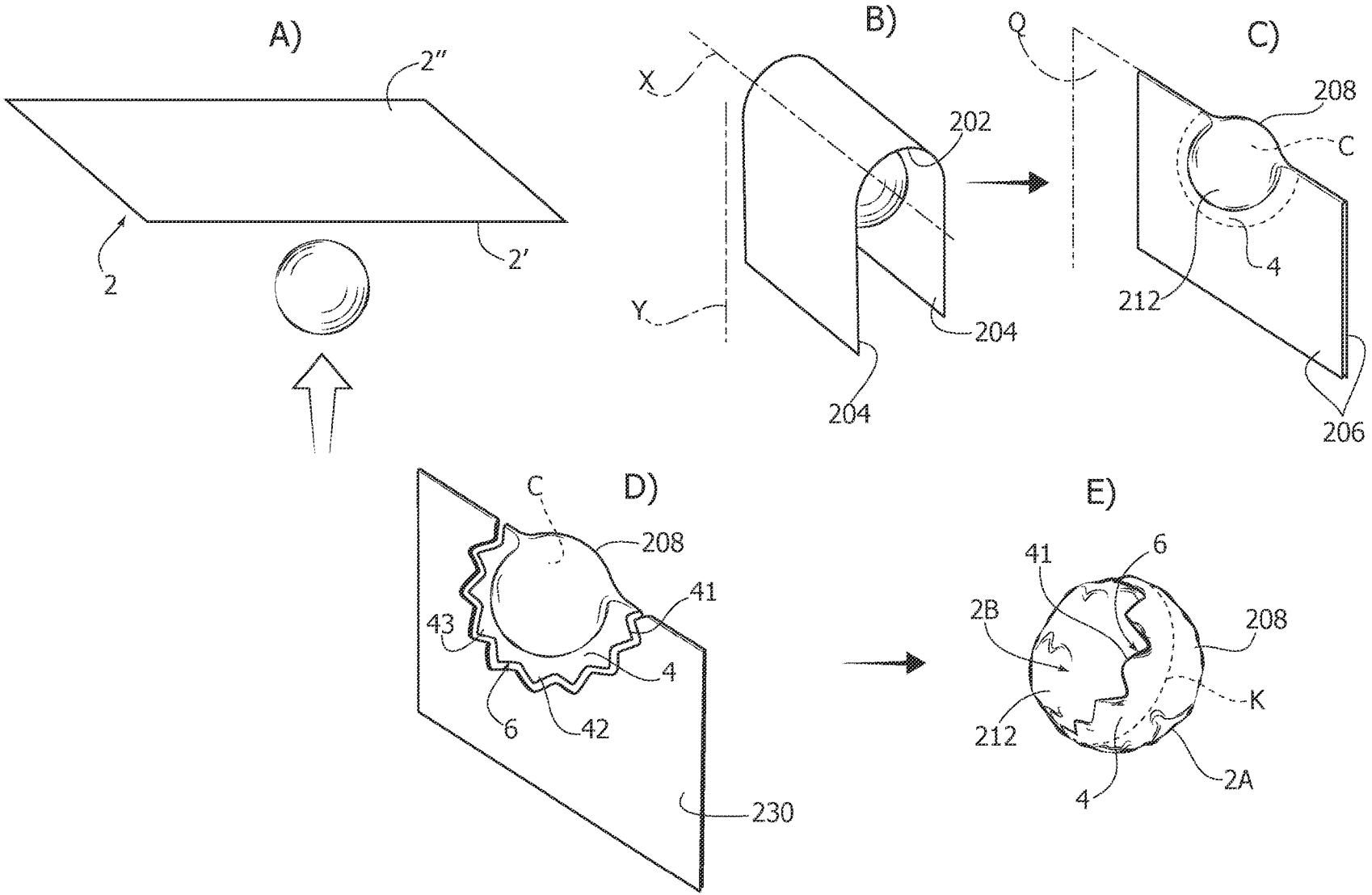
FIG. 2 is a schematic illustration of successive steps of the process described herein according to a preferred embodiment thereof.

With reference now to FIG. 2, this is a schematic illustration of an example of process for providing the package of FIG. 1.

In the first place, the wrapping sheet 2 for providing the package may be made of any material commonly used in the technical field here of interest. By way of example, there may be cited: 1) sheets of aluminium, preferably coated with thermally adhesive material, for example polyethylene and polypropylene; 2) sheets of plastic material, possibly laminates, for example with a base of propylene, polythene, polypropylene, polyester, polyethylene, polypeptide, and polyamide; or again 3) coupled sheets, obtained from various combinations of paper, cardboard, aluminium, and plastic materials of various nature (including the materials referred to above).

The sheet 2 has an inner side 2', designed to be set in direct contact with the product P and to delimit the cavity C in which the product P is received, and an outer side 2", which is to constitute the outer surface of the package.

Hence, starting from the single wrapping sheet 2, this is arranged with its inner side 2' in contact with the product P (step A), and is then folded to form a U around the product so as to form a looplike portion 202, which receives the product, and two parallel branches 204, which extend beyond the product P (step B).

The looplike portion 202 is the result of folding of the sheet over the product, about the direction X, and the two branches 204 extend parallel in the direction Y orthogonal to the direction X.

As shown in FIG. 2, the sheet 2 folded to form a U extends beyond the product P both in the direction of folding X and in the orthogonal direction Y.

As a result of the modality of folding referred to, only corresponding portions of the inner side 2' are arranged facing one another and facing the product.

The corresponding portions 206 that extend beyond the product P are then set in mutual contact in order to close the sheet around the product, thus creating the inner cavity C.

As anticipated above, the portions in question are set in contact in an equatorial plane Q of the product.

This plane separates the sheet between a portion 208 that is to constitute the upper side of the package and a portion 212 that is to constitute the lower side.

Incidentally, it will be noted that the position of the plane Q depends upon the specific shape of the product P, and hence the plane Q may even not be an equatorial plane.

At this point, the process envisages an operation of welding of the portions 206 so as to create the sealing portion 4 (step C).

As may be seen in the figures, this is provided immediately adjacent to the inner cavity C and extends throughout the development, around said cavity, of the aforesaid portions of the sheet in mutual contact.

Once the portion 4 is obtained, the cavity C is hence hermetically sealed.

Alternatively, the sealing portion 4 may be obtained via an operation of gluing, for example via application of lacquers or glues before the portions 206 are set in contact with one another.

Next, the process envisages a cutting operation (step D) that performs the following tasks:

separating the part 230 in excess of the wrapping sheet;
providing the final profile of the sealing portion 4; and
providing the tear-triggering point 6.

As a result of the above cutting operation, the sealing portion 4 is hence completed.

Finally, the sealing portion 4 is folded against the portion 212 that is to constitute the lower side 2B of the package.

As has been seen above, the portion 4 is folded along the line K, which represents the line where the portions 206 meet in the aforesaid equatorial plane.

The above folding line is immediately adjacent to the inner cavity C.

To return now to the cutting operation referred to above, this, as has been seen, determines the final profile of the sealing portion 4 and at the same time provides the tear-triggering point 6.

According to preferred embodiments, this operation is carried out on the basis of the considerations provided below.

Preferably, the sealing portion 4 has a width smaller than its longitudinal extension around the cavity C in order to facilitate folding thereof and, moreover, in order to limit the impact that it may have on the external appearance of the package.

On the other hand, preferably the tear-triggering point 6 is positioned on the portion 4 so as to be easily identifiable by the consumer and so as to render convenient tearing of the sheet and access to the inside of the cavity C.

In various preferred embodiments, like the ones illustrated, the cutting operation forms an end edge 41 of the portion 4 that is shaped so as to define one or more tear-triggering points 6 and tabs 42, 43 opposed with respect to the individual tear-triggering point, which are prearranged for being gripped by the consumer when the latter wishes to tear the wrapping starting from the point 6.

Figure 3B:
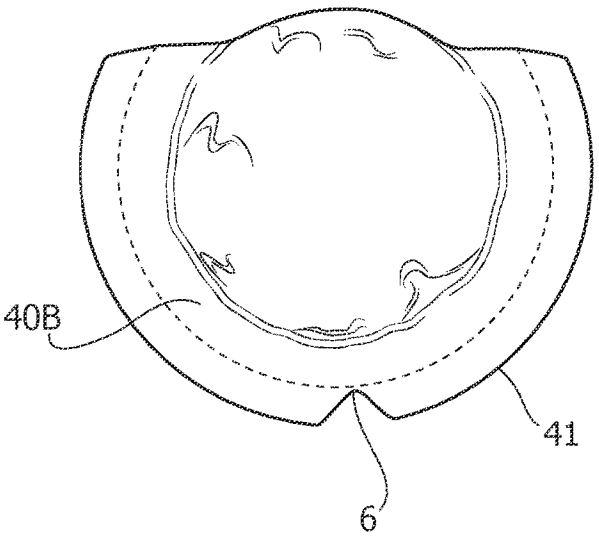
FIGS. 3A and 3B illustrate two variant embodiments of the package described herein.
Figure 3A:
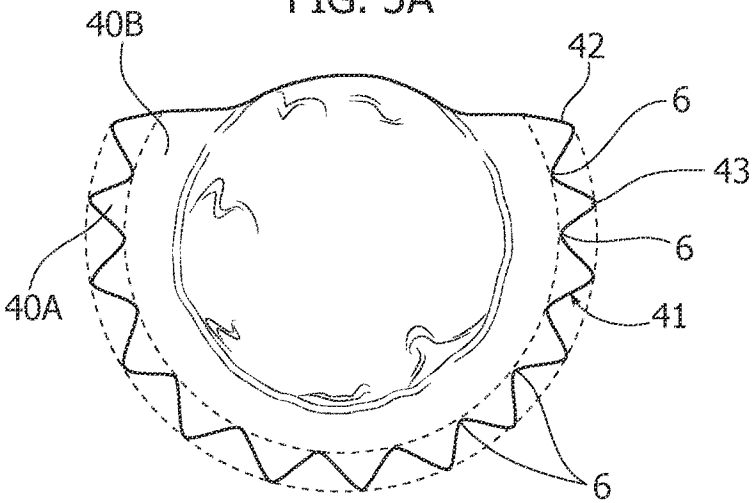

FIGS. 3A and 3B illustrate two different variant embodiments of the portion 4 and of the corresponding end edge 41.

In the solution illustrated in FIG. 3A, the end edge 41 describes a sawtooth profile such that each trough point of the profile constitutes a tear-triggering point, and the triangular segments adjacent to the trough point and opposed to one another constitute the aforesaid tabs 42, 43 that the consumer can get hold of to tear away the wrapping.

Once again with reference to the above solution, identified on the portion 4 are two substantially concentric regions that extend around the cavity C, a first outer region 40A, which encloses the sawtooth profile of the end edge 41, and an inner region 40B, which is set between the outer region and the portion of the wrapping defining the inner cavity C.

Preferably, the height and width of the triangular segments 42, 43 of the sawtooth profile have dimensions of up to 2·L, where L is the average width of the inner region 40B.

According to this configuration, the triangular segments are relatively large so as to facilitate gripping by the consumer. At the same time, hermetic sealing of the package is guaranteed by the inner region 40B that keeps the aforesaid segments separate from the inner cavity C.

Evidently, the solution in question affords the advantage of having a plurality of tear-triggering points so that the consumer will be able to choose where to start tearing the wrapping.

With reference now to FIG. 3B, in the solution illustrated therein the end edge 41 describes, instead, a circular profile, substantially corresponding to the profile in plan view of the portion of the wrapping that delimits the cavity C, which is, however, interrupted by a V-shaped notch defining a tear-primer point 6.

The V-shaped notch is preferably positioned in a central region of the portion 4, with respect to the longitudinal extension of the latter around the product P so as to be immediately visible to the consumer and so as to enable start of tearing of the wrapping in a direction substantially aligned with a mid-plane of the product.

Also in such a solution, on the portion 4 it is possible to identify an inner region 40B that separates the tear-primer point 6, in this case the V-shaped notch, from the inner cavity C.

It should be noted that it is, however, possible to envisage further variant embodiments of the portion 4 and of its end edge 41; for example, as compared to the solution illustrated in FIG. 3B, further variants may differ on account of the shape and/or position of the notch, the shape of the end edge, etc.

As has been seen above, whatever its specific configuration, in the finished package the sealing portion 4 will be folded on the lower side of the package, with the consequent advantages highlighted above.

Figure 4:
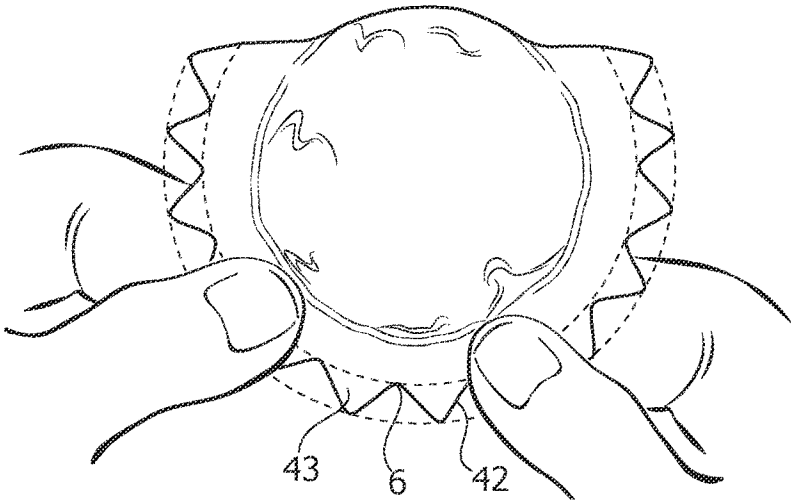
FIG. 4 represents, by way of example, a mode of opening of the package of FIG. 1.

As regards the mode of opening of the package, it should simply be noted that, when the consumer picks up the package to open it, he will immediately notice the presence, on the lower side 2B, of the folded portion 4 and of the tear-primer point (or points) 6 provided thereon, and can then simply pull the portion 4 outwards and start tearing the wrapping starting from the point 6 (FIG. 4).

Of course, without prejudice to the principle of the invention, the details of construction and the embodiments may vary, even significantly, with respect to what has been illustrated herein purely by way of non-limiting example, without thereby departing from the scope of the invention, as defined by the annexed claims.

The invention claimed is:

1. A package (10) for a foodstuff product, comprising a wrapping sheet (2) that is wrapped around said product (P) so as to enclose it within a cavity (C) that is delimited by said sheet and so as to remain adherent to an outer surface of said product (P), wherein said sheet (2) wrapped around said product has a first side (2A) and a second side (2B) opposite to one another, wherein:

said sheet has a sealing portion (4), in which flaps (206) of said sheet are brought into contact with one another starting from a plane (Q) that separates said first and second sides (2A, 2B) of said package and are sealed to one another so as to close said inner cavity (C) hermetically, said sealing portion (4) has a point (6) of facilitated opening; and said sealing portion (4) is folded about a folding line (K), which is contained in said plane, towards said second side (2B) and against a corresponding portion of said sheet (2) that wraps said product so that said point (6) of facilitated opening comes to be positioned on said second side (2B), wherein said sealing portion (4) extends longitudinally along said plane (Q) following a profile that the portion of said sheet that wraps said product has in said plane, wherein said point (6) of facilitated opening is a tear-triggering point, wherein said sealing portion has an end edge (41) shaped so as to define at least one tear-triggering point and tabs (42, 43) opposed to one another with respect to said point (6), which are such as to define portions that can be gripped by a consumer, wherein said sealing portion has an inner region (40A) with a substantially constant width, which extends along said sealing portion and separates said tear-triggering point (6) from said inner cavity (C), and wherein said end edge (41) has a sawtooth profile, which extends in a longitudinal direction of said sealing portion (4) and which is such that each trough point of said sawtooth profile identifies a tear-triggering point (6) and the respective triangular tabs (42, 43) opposed to one another with respect to the individual tear-triggering point (6), identify portions that can be gripped by the consumer, or wherein said end edge (41) has a profile substantially corresponding to the profile that the portion of said sheet that wraps said product has in said plane, and wherein along said end edge (41) a V-shaped notch constituting said tear-triggering point (6) is provided.

2. The package according to claim 1, wherein said first side (2A) is an upper side or front side of said package, and said second side (2B) is a lower side or rear side of said package.

3. The package according to claim 1, wherein said folding line (K) is immediately adjacent to said inner cavity (C), and wherein said sealing portion (4) is adherent to said corresponding portion, against which it is set in contact.

4. A process for making a package for foodstuff products, comprising the steps of:

supplying a wrapping sheet (2) having a first region (208) such as to define a first side (2A) of said package, and a second region (212) such as to constitute a second side (2B) of said package opposite to said first side (2A);

bringing said sheet (2) into contact with said product (P) and wrapping said wrapping sheet around said product so as to bring into mutual contact corresponding portions (206) of said sheet (2) that extend beyond said product and to form an inner cavity (C) in which said product (P) is housed, wherein said portions are in mutual contact in a plane (Q) that separates said first region (208) and said second region (212) of said sheet;

providing, on said portions (206) in mutual contact, a sealing portion (4) that hermetically closes said inner cavity (C);

providing a point (6) of facilitated opening on said sealing portion (4);

folding said sealing portion about a folding line (K) contained in said plane, against said second region (212) so that said point (6) of facilitated opening comes be positioned on said second side (2B) of said package, wherein said sealing portion (4) extends longitudinally along said plane (Q) following a profile that a portion of said sheet that wraps said product has in said plane, wherein said point (6) of facilitated opening is a tear-triggering point, wherein said sealing portion has an end edge (41) shaped so as to define at least one tear-triggering point and tabs (42, 43) opposed to one another with respect to said point (6), which are such as to define portions that can be gripped by a consumer, wherein said sealing portion has an inner region (40A) with a substantially constant width, which extends along said sealing portion and separates said tear-triggering point (6) from said inner cavity (C), and wherein said end edge (41) has a sawtooth profile, which extends in a longitudinal direction of said sealing portion (4) and which is such that each trough point of said sawtooth profile identifies a tear-triggering point (6) and the respective triangular tabs (42, 43) opposed to one another with respect to the individual tear-triggering point (6), identify portions that can be gripped by the consumer, or wherein said end edge (41) has a profile substantially corresponding to the profile that the portion of said sheet that wraps said product has in said plane, and wherein along said end edge (41) a V-shaped notch constituting said tear-triggering point (6) is provided.

5. The process according to claim 4, wherein said first side (2A) is an upper side or front side of said package and said second side (2B) is a lower side or rear side of said package.

6. The process according to claim 4, wherein providing said sealing portion includes sealing or gluing together said corresponding portions set in contact (106) along a region, which is set in said plane, is located immediately adjacent to said inner cavity (C), and extends around said cavity (C) so as to close it hermetically.

7. The process according to claim 4, wherein providing said point of facilitated opening includes carrying out a cutting operation on said sealing portion (4) that forms a shaped end edge (41) provided with a tear-triggering point (6).

8. The process according to claim 4, wherein folding said sealing portion (4) includes defining a folding line (k) that is immediately adjacent to said inner cavity (C).

* * * * *